US006129585A

United States Patent [19]

Hashizawa et al.

[11] Patent Number: 6,129,585

[45] Date of Patent: Oct. 10, 2000

[54] SHIELD CIRCUIT CONNECTION STRUCTURE FOR SHIELDED CONNECTOR DIRECT ATTACHMENT

[75] Inventors: Shigemi Hashizawa; Hidehiko Kuboshima, both of Shizuoka-ken, Japan

[73] Assignee: Yazaki Corporation, Tokyo, Japan

[21] Appl. No.: 09/175,583

[22] Filed: Oct. 20, 1998

[30] Foreign Application Priority Data

Oct. 21, 1997 [JP] Japan ..... 9-288775

[51] Int. Cl.[7] ..... H01R 13/648

[52] U.S. Cl. ..... 439/607; 439/939

[58] Field of Search ..... 439/607, 939, 439/752, 609, 587, 274, 275

[56] References Cited

U.S. PATENT DOCUMENTS 5,971,811 10/1999 Mori et al. ..... 439/939

FOREIGN PATENT DOCUMENTS 8-64306 3/1996 Japan .

*Primary Examiner*—Lincoln Donovan

*Assistant Examiner*—Javaid Nasri

*Attorney, Agent, or Firm*—Finnegan, Henderson, Farabow, Garrett & Dunner, L.L.P.

[57] ABSTRACT

A connector body is attached to a conductive casing of an electrical apparatus and provided with a shield terminal to be electrically connected to the conductive casing, an attachment hole is formed in the conductive casing, an insert is formed to the connector body, a plurality of contacts are formed to the shield terminal and arranged to the insert, elastically contacting a wall of the attachment hole, as the insert is inserted in the attachment hole.

29 Claims, 4 Drawing Sheets

SHIELD CIRCUIT CONNECTION STRUCTURE FOR SHIELDED CONNECTOR DIRECT ATTACHMENT

BACKGROUND OF THE INVENTION

1. Field of the Invention

The present invention relates to a shield circuit connection structure for a shielded connector to be directly attached to a variety of electrical apparatuses.

2. Description of the Related Art

FIGS. 1 and 2 illustrate a conventional shield circuit connection structure for shielded connector direct attachment shown in Japanese Patent Application Laid-Open Publication No. 8-64306. An associated shielded connector 1 is provided with an insulating connector housing 2 and a conductive metallic shell 4 accommodated therein. The connector housing 2 has, at its end to be attached, a mount seat integrally resin-molded therewith, with a square back surface portion 3 called "scat face".

The metallic shell 4 is comprised of a metallic cylinder 4*a* and a number of sheets of contact pieces 4*b* radially bent at an end of the cylinder 4*a*. The cylinder 4*a* is connected to a conduction terminal (not shown) installed in the housing 2 for an extended connection to a braid (not shown) of a shielded wire, so that the cylinder 4*a* is electrically connected to the braid.

As shown in FIG. 1, the contact pieces 4*b* of the metallic shell 4 are substantially flush with the seat face 3, to be brought into surface contact with a conductive casing (not shown) of an electrical apparatus when the seat face 3 contacts thereto.

The shielded connector 1 is placed on the casing of the electrical apparatus in a surface contacting manner, and four fixing bolts 5 are applied through bolt holes 3*a* at corners of the seat face 3 and screwed to the casing, for direct attachment of the connector 1 thereto. As the contact pieces 4*b* contact the conductive casing, this casing is electrically connected via the cylinder 4*a* and conduction terminal to the braid of the shielded wire.

The resin molded seat face 3 receives heat such as from the electrical apparatus and the shielded wire, and has a tendency to deform, which is significant if a waterproof packing or the like intervenes between the seat face 3 and the apparatus casing, therefor allowing an intervening object to produce a reaction force. A resultant deformation of the seat face 3 causes an incomplete contact of the seat face 3 to the casing, with a reduced contact pressure between a respective contact piece 4*b* of the shell 4 and the apparatus casing.

Further, external forces tend to act on the contact pieces 4*b*, causing a deformation or drop.

SUMMARY OF THE INVENTION

The present invention has been achieved with a view toward overcoming these exemplary disadvantages of the related art.

It therefore is an exemplary object of the present invention to provide a shield circuit connection structure for a shielded connector direct attachment so as to permit a secure conduction to an apparatus casing and preventing deformations of at least one contact piece.

To achieve the object, a first aspect of the invention provides a shield circuit connection structure for shielded connector direct attachment, in which a connector body is attached to conductive casing of an electrical apparatus and has a shield terminal to be electrically connected to the conductive casing, the shield circuit connection structure comprising an attachment hole formed in the conductive casing, an insert formed to the connector body, and a plurality of contacts formed to the shield terminal and arranged to the insert, the plurality of contacts elastically contacting a wall of the attachment hole, as the insert is inserted in the attachment hole.

According to this aspect of the invention, a plurality of contacts formed on a shield terminal are arranged to an insert which is formed to a connector body of a connector, so that they elastically contact a wall of an attachment hole formed in a conductive casing of an electrical apparatus, when the insert of the connector body is inserted in the attachment hole, and the elastic contact provides an conduction between the shield terminal and the conductive casing.

As the plurality of contacts elastically contact the wall of the attachment hole, even when a seat face of the connector is thermally deformed, they will not be separated from the wall, thus keeping a favorable contacting state without undue contact pressures, permitting an ensured conduction.

According to a second aspect of the invention, the shield circuit connection structure further comprises a rear holder fitted to the insert from outside for holding the plurality of contacts.

According to this aspect of the invention, a rear holder to be provided at a rear end of a connector body for holding a shield terminal in the connector body is fitted to an insert of the connector body, and holds contacts of the shield terminal According to a third aspect of the invention, the rear holder has a plurality of projections intervening between the plurality of contacts.

According to this aspect of the invention, as a rear holder is fitted to an insert of a connector body, projections of the holder intervene between contacts of a shield terminal, separating the contacts, protecting them from external forces, preventing their deformation.

According to a fourth aspect of the invention, the rear holder has a cover portion for covering the plurality of contacts from outside.

According to this aspect of the invention, contacts of a shield terminal are protected from undue external forces, and prevented from being damaged or deformed.

According to a fifth aspect of the invention, the shield circuit connection structure further comprises a pin terminal provided in the connector body, and an electric wire held by the rear holder and connected to the pin terminal.

According to this aspect of the invention, a rear holder cooperates with a connector body to hold a combination of a pin terminal and an electric wire connected thereto, at two distant locations, i.e. at a location where the pin terminal is fixed to the connector body and at a location where the electric wire is held by the rear holder. The pin terminal has a reduced twisting tendency, permitting a facilitated connection thereof to a core wire of a shielded wire.

BRIEF DESCRIPTION OF THE DRAWINGS

The other and further objects and novel features of the present invention will more fully appear from the following detailed description when the same is read in conjunction with the accompanying drawings, in which.

DETAILED DESCRIPTION OF THE PREFERRED EMBODIMENT

Figure 1:
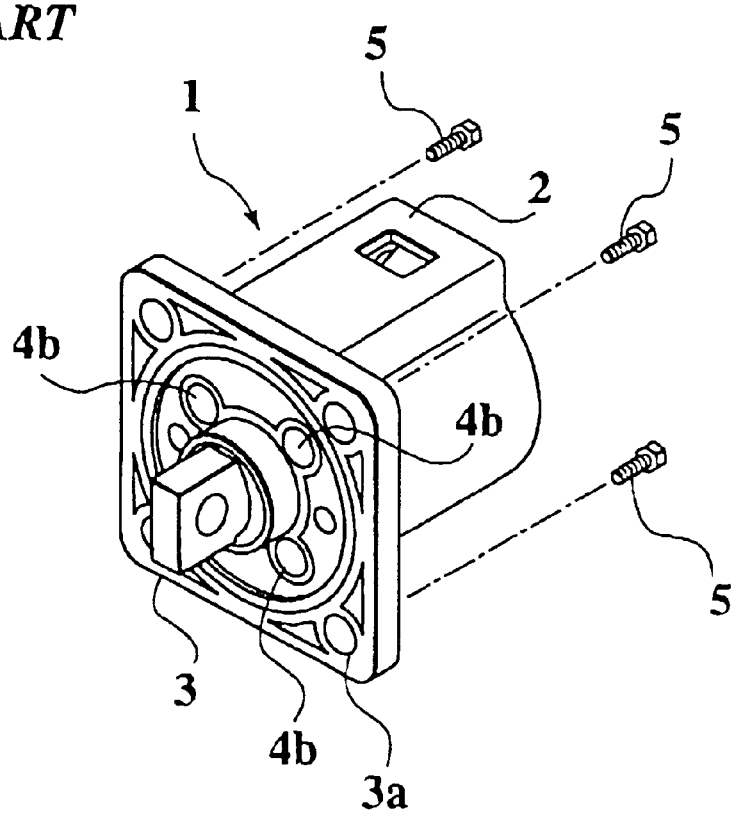
FIG.1 PRIOR ART
FIG. 1 is a perspective view of a shield connector in a conventional shield circuit connection structure.
Figure 2:
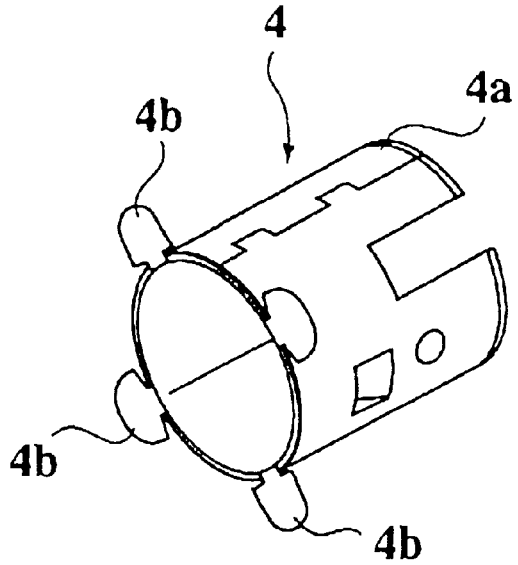
FIG.2 PRIOR ART
FIG. 2 is a perspective view of a metallic shell in the shield connector of FIG. 1.

There will be detailed below the preferred embodiments of the present invention with reference to the accompanying drawings. Like members are designated by like reference characters.

Figure 3:
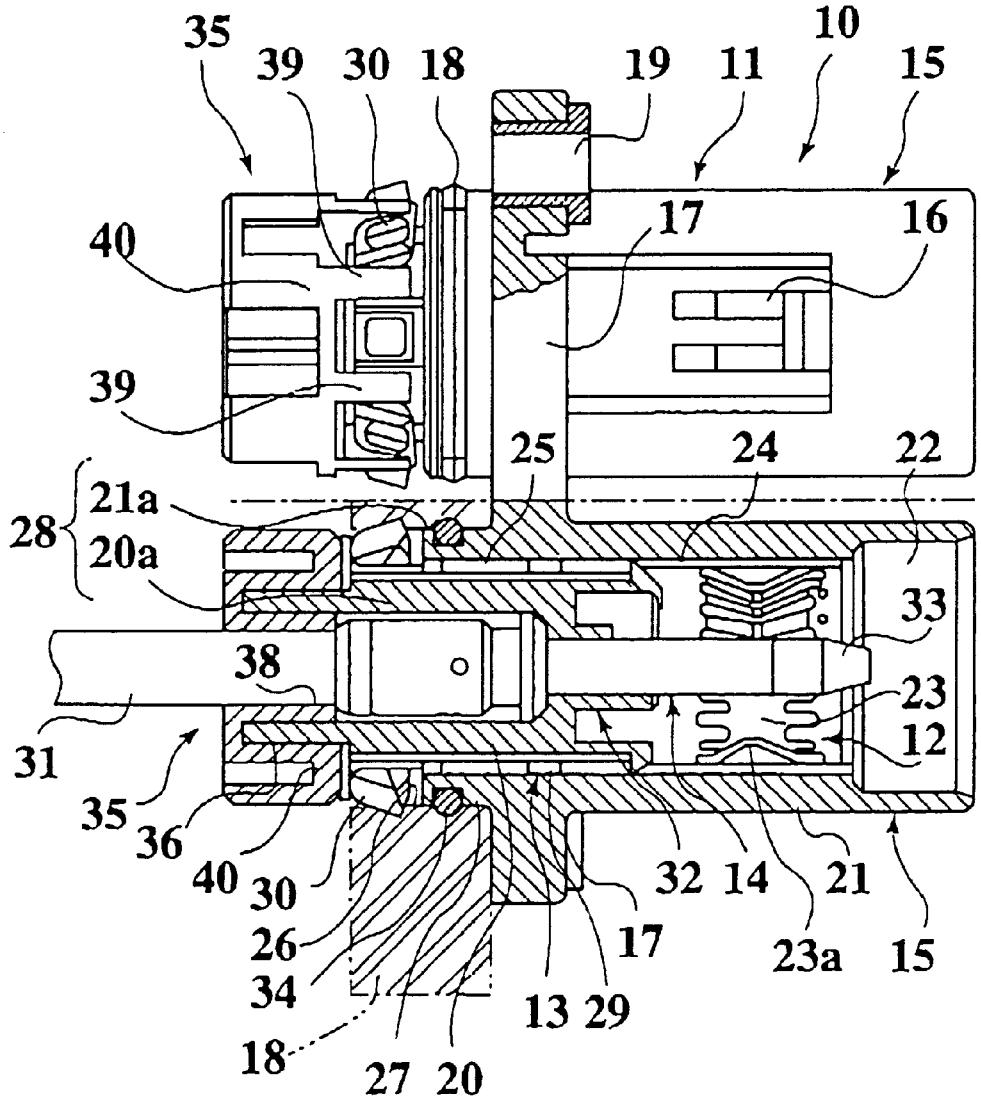
FIG. 3 is a plan, partly in section, of a shield circuit connection structure according to an embodiment of the invention.
Figure 4:
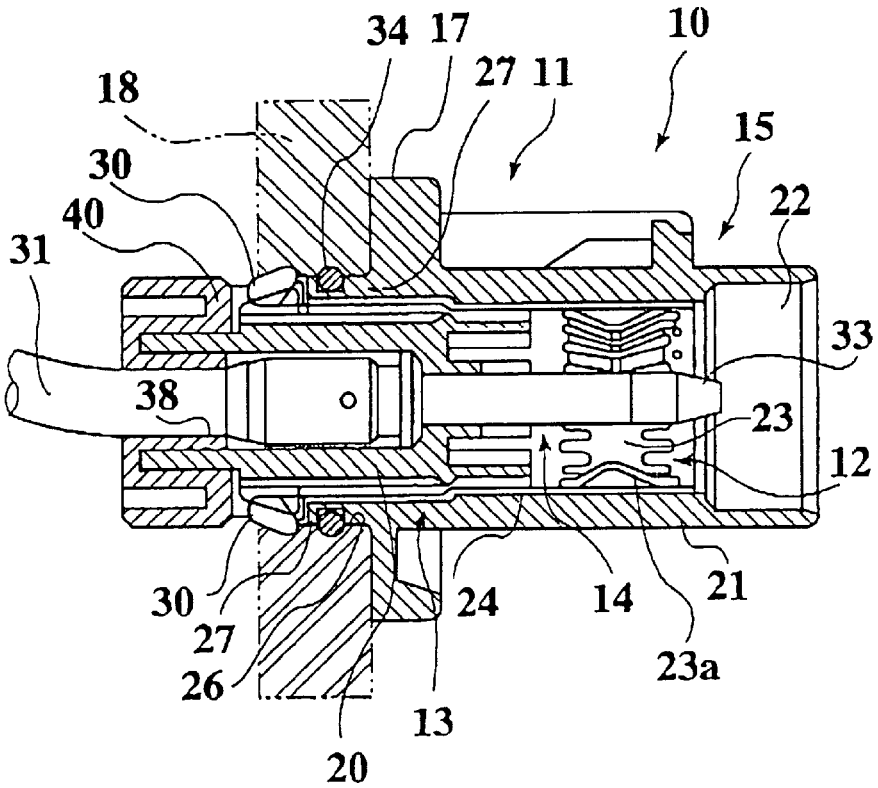
FIG. 4 is a longitudinal section of the shield circuit connection structure of FIG. 3.
Figure 5:
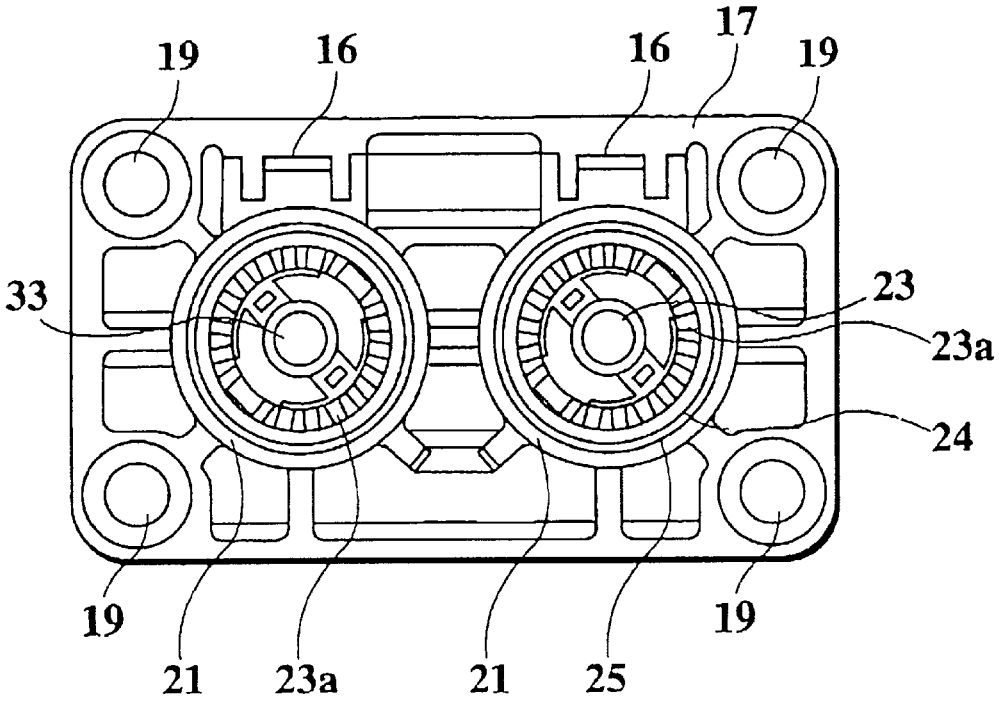
FIG. 5 is a front view of the shield circuit connection structure of FIG. 3.
Figure 6:
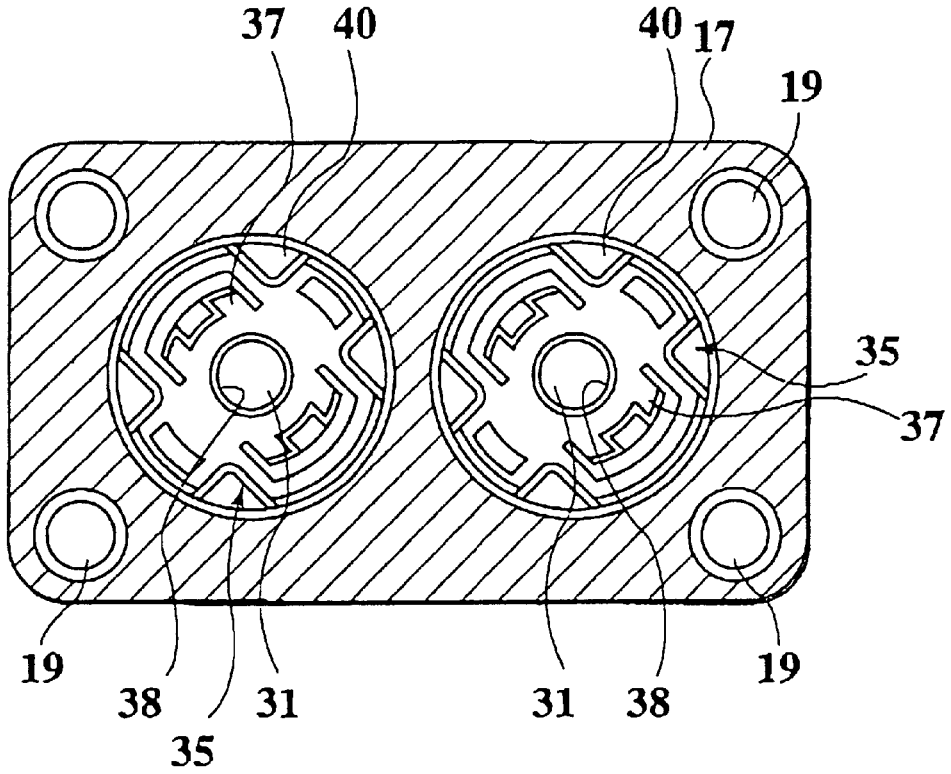
FIG. 6 is a rear view of the shield circuit connection structure of FIG. 3.

FIGS. 3 to 6 show a shield circuit connection structure according to an embodiment of the invention, in which FIG. 3 is a side view, FIG. 4, a section, FIG. 5, a front view, and FIG. 6, a rear view.

The shield circuit connection structure includes a shielded connector 10 comprising an insulating connector body 11, a pair of conduction terminals 12, a pair of shield terminals 13, and a pair of pin terminals 14.

The connector body 11 has a pair of connector housings 15, 15, a lock member 16 provided outside each connector housing 15, and a seat face 17 configured like a rectangular plate. The connector body 11 is a resin mold comprising the connector housings 15, 15 arranged in parallel and joined to each other through the rectangular seat face 17, which extends in a perpendicular direction thereto.

The seat face 17 abuts on a shield casing 18 of an electrical apparatus (hereinafter, simply "apparatus") in a surface contacting manner. The casing 18 of the apparatus is metallic and conductive. The seat face 17 is bolted for being fixed to the apparatus casing 18, and formed with bolt insertion holes 19 at four corners thereof.

The lock member 16 engages for locking with a lock member of a mating connector (not shown) whose housing mates to a corresponding connector housing 15. The mating connector is in turn, connected to a wire.

Each connector housing 15 has a duplex structure composed of an outer housing 21 and an inner housing 20. The outer housing 21 has at a right end thereof an axially extending connector insertion chamber 22 for the mating connector's housing to be fitted therein. A corresponding conduction terminal 12 is arranged inside the connector insertion chamber 22. The connector housing 15 fits to the apparatus casing 18 at a left end thereof.

At the left end, the connector housing 15 is inserted into an attachment hole 27 formed in the apparatus casing 18, to be directly attached thereto. For the attachment, the connector housing has an insert portion 28 comprising a left end part 21*a* of the outer housing 21 and an intermediate part 20*a* of a left portion of the inner housing 20. The left portion of the inner housing 20 extends beyond the left end part 21*a* of the outer housing 21, projecting inside the apparatus casing 18.

The conduction terminal 12 is a shaped thin metallic sheet that comprises a conducting part 23 and a connection part 24. The conducting part 23 comprises a tangentially successively corrugated cylindrical body with a number of axially wavy rises disposed at angular intervals over an inner circumference of a wall of the connector insertion chamber 22. The wavy rises constitute a resent conducting portion 23*a* to contact a metallic shield shell of the mating connector, which shell is connected to the shield wire in the mating connector.

The connection part 24 of the conduction terminal 12 tightly fits in the connector insertion chamber 22, tangentially extending along the chamber wall with a longer axial width than the conduction part 23. The connection part 24 has a leftward extension extending in a gap 25 between the inner and outer housings 20, 21, to contact a corresponding shield terminal 13, for an electrical connection thereto.

The shield terminal 13 comprises a shaped connection cylinder 29 with a number of raised contact pieces 30. The connection cylinder 29 extends inside the gap 25 between the inner and outer housings 20, 21, overlapping and contacting the extension of the connection part 24 of the conduction terminal 12, for an electrical connection therewith. The contact pieces 30 are arranged at a pitch on a circle, and outwardly extend from the connection cylinder 29 toward the apparatus casing 18, and are curvilinearly deformed to have round elastic or resilient ends.

The contact pieces 30 are thus arranged to or on the insert portion 28 of the connector housing 15. More specifically, each contact piece 30 rests at the back on the mediate part 20*a* of the left portion of the inner housing 20, and outwardly projects, radially exceeding an outside of the end part 21*a* of the outer housing 21. With the contact pieces 30 thus arranged, the insert portion 28 of the connector housing 15 is inserted in the attachment hole 27 of the apparatus casing 18. The contact pieces 30 elastically contact a wall 26 of the attachment hole 27, for an ensured electrical connection to the apparatus casing 18.

The pin terminal 14 is connected to a terminal of an insulated electric wire 31, such as by a clamping, and is axially inserted inside the inner housing 20, leading the electric wire 31 connected thereto. The pin terminal 14 extends inside the connector insertion chamber 22, and is connected to a contact of the mating connector fitted in the chamber 22, to constitute an additional shielded electric circuit connection.

At the right end of the inner housing 20 is formed an axially extending cylindrical terminal retaining portion 32. The pin terminal 14 is retained by a tight fit to the terminal retaining portion 32. An electric shock preventing projection 33 consisting of an insulator is attached to an end of the pin terminal 14, such as by a press-fitting.

The insert portion 28 has a seal ring 34 fitted thereon. The seal ring 34 is fitted in a groove therefor on the end part 21*a* of the outer housing 21, and constitutes the insert portion 28, serving as a waterproof element between the shielded connector 10 and the apparatus casing 18.

Figure 7:
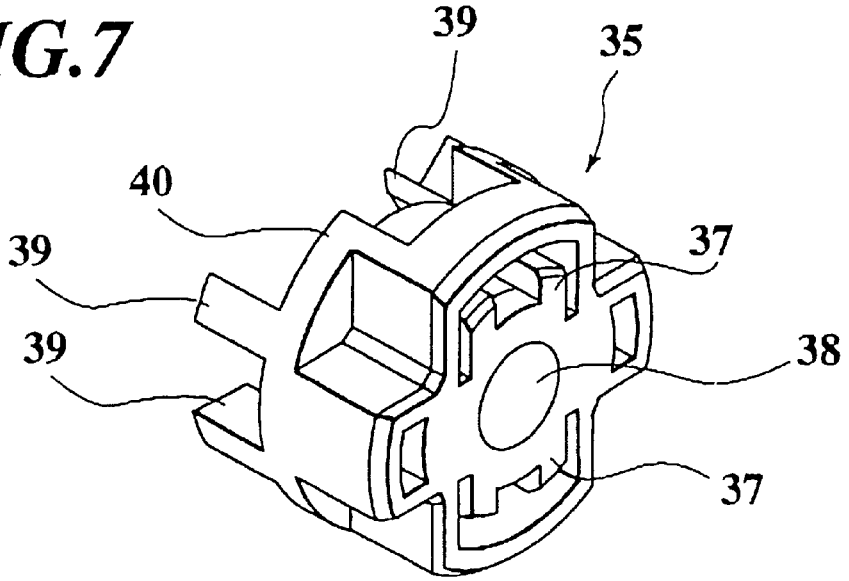
FIG. 7 is a perspective view of a rear holder in the shield circuit connection structure of FIG. 3.

This embodiment includes an insulating rear holder 35 made of resin, FIG. 7. The rear holder 35 fits to a left end of the connector housing 15 provided through the attachment hole 27 of the apparatus casing 18. For this purpose, the left portion of the inner housing 20 has a pair of axially extending upper and lower engagement pieces 36 formed at the left end of the intermediate part constituting the insert portion 28, to be engaged with the rear holder 35.

As shown in FIG. 7, the rear holder 35 has upper and lower pairs of engagement pawls 37 to be engaged with the engagement pieces 36 of the inner housing 20, and a central insertion hole 38 provided for the electric wire 31 to pass therethrough. The electric wire 31 tightly fits in this hole 38, so as to be retained or restrained therein.

The rear holder 35 has a plurality of projecting pieces 39 projecting toward the apparatus casing 18. The projecting pieces 39 are arranged at a pitch on a circle, like the contact pieces 30 of the shield terminal 13.

Neighboring two projecting pieces 39 have a spacing therebetween predetermined for insertion of a corresponding contact piece 30. When the rear holder 35 is fitted to the connector housing 15, each contact piece 30 intervenes between a corresponding pair of projecting pieces 39. The contact pieces 30 are thus protected from external forces, and will not deform.

The rear holder 35 has a base 40 for the projecting pieces 39, which is configured annular to serve as a contact piece covering portion 40, with an adequate diameter to cover the contact pieces 30. When the rear holder 35 fits to the connector housing 15, the contact piece covering portion 40 envelopes the contact pieces 30 from outside, thereby preventing them and the shield terminal 13 from slipping out. Further, the contact pieces 30 are thus protected from undue external forces, and will not deform.

Next, the assembly of the structure described will be explained. First, the pin terminal 14 connected to the electric wire 31 is passed through the rear holder 35. On the other hand, the insert portion 28 of each connector housing 15 is inserted in a corresponding attachment hole 27 of the conductive apparatus casing 18, and the seat face 17 abuts on an outside of the apparatus casing 18.

Along with the insertion of the insert portion 28, the contact pieces 30 of the shield terminal 13 arranged to or on the insert portion 28 so as to elastically contact the wall 26 of the attachment hole 27, and the shield terminal 13 and the apparatus casing 18 are electrically connected to each other. With such elastic contact of the contact pieces 30, the connector body 11 is temporarily retained to the apparatus casing 18, and kept from a careless drop.

Then, the pin terminal 14 is axially inserted in the inner housing 20, and the engagement pawls 37 of the rear holder 35 are brought into engagement with the engagement pieces 36 of the inner housing 20, whereby the rear holder 35 is attached.

Then, bolts are applied to the bolt insertion holes 19 of the seat face 17 and screwed to the apparatus casing 18. The connector body 11 is thus fixed to the apparatus casing 18. As the contact pieces 30 are elastically contacting the wall 26 of each attachment hole 27, the connector body 11 is retained or held, without occasional drop, thereby facilitating a holding effect or a fixed connection between the connector body 11 and the apparatus casing 18. Such a holding effect is enhanced with the pin terminal 14 retained by the terminal retaining portion 32 of the inner housing 20 and the electric wire 31 retained at the central insertion hole 38 of the rear holder 35.

According to the embodiment, the contact pieces 30 of the shield terminal 13 are inserted into the attachment hole 27 of the apparatus casing 18 and elastically contact the wall 26 of the attachment hole 27. Therefore, even if the connector seat face 11 is thermally deformed, the contact pieces 30 keep contacting the wall 26 of the attachment hole 27, with a contact pressure therebetween, and a conductive shield circuit is provided between the connector body 11 and the apparatus casing 18.

Further, the pin terminal 14 is retained by the terminal retaining portion 32 of the inner housing 20 and the electric wire 31 connected to the pin terminal 14 is also retained by the insertion hole 38 of the rear holder 35. Therefore, the pin terminal 14 is retained at two locations along its length, to provide a stable, twist free contact between the mating connection and the pin terminal 14.

While preferred embodiments of the present invention have been described using specific terms, such description is for illustrative purposes, and it is to be understood that changes and variations may be made without departing from the spirit or scope of the following claims.

What is claimed is:

1. A shield circuit connection structure for use with a connector body attached to a conductive casing of an electrical apparatus and a shield terminal electrically connected to the conductive casing, the shield circuit connection structure comprising:

an attachment hole formed in the conductive casing;

an insert formed on at least one connector housing of the connector body; and a plurality of contacts formed on the shield terminal and arranged on the insert, the plurality of contacts elastically contacting a wall of the attachment hole, when the insert on the at least one connector housing is inserted in the attachment hole so as to provide an electrical connection between at least one of the plurality of contacts and the conductive casing.

2. The shield connection structure as claims in claim 1, further comprising a rear holder fitted to the insert from outside for holding the plurality of contacts.

3. The shield circuit connection structure as claimed in claim 2, wherein the rear holder has a plurality of projections intervening between the plurality of contacts.

4. The shield circuit connection structure as claimed in claim 2, wherein the rear holder has a cover portion for covering an external surface of the plurality of contacts.

5. The shield circuit connection structure as claimed in claim 2, further comprising:

a pin terminal provided in the connector body; and an electric wire held by the rear holder and connected to the pin terminal.

6. The shield connection structure according to claim 1, wherein the connector body includes a lock member provided outside the at least one connector housing, and a rectangular seat face configured to abut the conductive casing.

7. The shield connection structure according to claim 6, wherein the at least one connector housing includes inner and outer housings.

8. The shield connection structure according to claim 7, wherein the insert includes an insert portion comprising a left end part of the outer housing and an intermediate part of a left portion of the inner housing.

9. A shield circuit connection structure comprising:

a connector body attached to a conductive casing and having at least one connector housing;

a shield terminal electrically connected to the conductive casing;

an insert formed on the at least one connector housing of the connector body; and an attachment hole formed in the conductive casing and having a wall for receiving the insert;

a plurality of contacts formed on the shield terminal and arranged on the insert, the plurality of contacts elastically contacting the wall of the attachment hole when the insert on the at least one connector housing is inserted in the attachment hole so as to provide an electrical connection between at least one of the plurality of contacts and the conductive casing.

10. The shield circuit connection structure according to claim 9, wherein the at least one connector housing includes inner and outer housings, a lock member provided outside each of the inner and outer housings, and a rectangular seat face configured to abut the conductive casing.

11. The shield circuit connection structure according to claim 10, wherein the insert includes an insert portion comprising a left end part of the outer housing and an intermediate part of a left portion of the inner housing.

12. The shield circuit connection structure according to claim 9, further comprising:

a rear holder fitted to the insert for holding the plurality of contacts.

13. The shield circuit connection structure according to claim 12, wherein the rear holder includes a plurality of projections defining at least one space for cooperating with the plurality of contacts when the rear holder is fitted to a connector housing of the connector body.

14. The shield circuit connection structure according to claim 12, wherein the plurality of contacts radially extend from a connection cylinder of the shield terminal and the rear holder includes a cover portion for covering the plurality of contacts when the rear holder is fitted to a connector housing of the connector body.

15. The shield circuit connection structure according to claim 12, further comprising:

a pin terminal provided in the connector body; and an electric wire held by the rear holder and connected to the pin terminal when the rear holder is fitted to a connector housing of the connector body.

16. A shield circuit connection structure comprising:

a connector body configured for being attached to a conductive casing of an electrical apparatus, the connector body having an insert;

a shield terminal electrically connected to the conductive casing;

an attachment hole formed in the conductive casing;

a plurality of elastic contacts formed on the shield terminal and arranged on the insert for elastically contacting a wall of the attachment hole when the insert is inserted in the attachment hole; and a rear holder fitted to the insert for holding the plurality of contacts when the insert is inserted in the attachment hole.

17. The shield circuit connection structure of claim 16, wherein the rear holder includes a plurality of projections configured for engaging the plurality of elastic contacts.

18. The shield circuit connection structure of claim 17, wherein the plurality of projections of the rear holder define at least one space for receiving one of the plurality of elastic contacts.

19. The shield circuit connection structure of claim 16, wherein the rear holder is configured for covering a selected portion of each of the plurality of elastic contacts.

20. A shield circuit connection structure comprising:

a connector body configured for being attached to a conductive casing of an electrical apparatus, the connector body including an insert, at least one connector housing, a lock member provided outside the at least one connector housing, and a rectangular seat face configured to abut the conductive casing;

a shield terminal electrically connected to the conductive casing;

an attachment hole formed in the conductive casing; and a plurality of elastic contacts formed on the shield terminal and arranged on the insert for elastically contacting a wall of the attachment hole when the insert is inserted in the attachment hole.

21. The shield circuit connection structure of claim 20, wherein the at least one connector housing includes inner and outer housings.

22. The shield circuit connection structure of claim 21, wherein the insert includes an end portion connected to the outer housing and an intermediate part connected to the inner housing.

23. The shield circuit connection structure according to claim 20, further comprising:

a rear holder fitted to the insert for holding the plurality of contacts.

24. The shield circuit connection structure according to claim 23, wherein the rear holder includes a plurality of projections defining at least one space for receiving one of the plurality of contacts when the rear holder is fitted to the at least one connector housing of the connector body.

25. The shield circuit connection structure according to claim 23, wherein the plurality of contacts radially extend from a connection cylinder of the shield terminal and the rear holder includes a cover portion for covering the plurality of contacts when the rear holder is fitted to the at least one connector housing of the connector body.

26. The shield circuit connection structure according to claim 23, further comprising:

a pin terminal provided in the connector body; and an electric wire held by the rear holder and connected to the pin terminal when the rear holder is fitted to the at least one connector housing of the connector body.

27. A shield circuit connection structure comprising:

a connector body configured for being attached to a conductive casing and having first and second connector housings;

a shield terminal electrically connected to the conductive casing;

an insert portion having a first part on the first connector housing and a second part on the second connector housing of the connector body; and an attachment hole formed in the conductive casing and having a wall for receiving the insert portion;

a plurality of contacts formed on the shield terminal and arranged on the insert portion, the plurality of contacts elastically contacting the wall of the attachment hole when the insert portion is inserted in the attachment hole so as to provide an electrical connection between at least one of the plurality of contacts and the conductive casing.

28. The shield circuit connection structure according to claim 27, further comprising:

a rear holder fitted to the insert portion for holding the plurality of contacts in engagement with the at least one of the plurality of contacts.

29. The shield circuit connection structure according to claim 28, wherein the rear holder includes a plurality of projections defining at least one space for receiving one of the plurality of contacts when the rear holder is fitted to the at least one connector housing of the connector body.

* * * * *

UNITED STATES PATENT AND TRADEMARK OFFICE

CERTIFICATE OF CORRECTION

PATENT NO. 6,129,585

DATED: October 10, 2000

INVENTORS: Shigemi HASHIZAWA and Hidehiko KUBOSHIMA

It is hereby certified that errors appear in the above-identified patent and that said Letters Patent is hereby corrected as shown below:

In Claim 2, col. 6, line 25, "as claims" should read --as claimed--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*